US007357641B2

(12) United States Patent
Kerekes et al.

(10) Patent No.: US 7,357,641 B2
(45) Date of Patent: Apr. 15, 2008

(54) CARD EDGE COAXIAL CONNECTOR

(75) Inventors: James R. Kerekes, Waterville, MN (US); M'hamed Anis Khemakhem, Minnetonka, MN (US); Eric L. Lovaasen, Chaska, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/489,366

(22) Filed: Jul. 18, 2006

(65) Prior Publication Data

US 2006/0258180 A1 Nov. 16, 2006

Related U.S. Application Data

(63) Continuation of application No. 11/138,093, filed on May 26, 2005, now Pat. No. 7,118,382, which is a continuation of application No. 10/114,897, filed on Apr. 2, 2002, now Pat. No. 6,935,866.

(51) Int. Cl.
*H01R 12/00* (2006.01)

(52) U.S. Cl. ..... 439/63

(58) Field of Classification Search ..... 439/63, 439/65, 374, 545, 547, 549, 629
See application file for complete search history.

(56) References Cited

U.S. PATENT DOCUMENTS

| | | | | |
|---|---|---|---|---|
| 3,553,607 | A | | 1/1971 | Lehrfeld |
| 3,594,708 | A | | 7/1971 | Lalonde |
| 3,622,915 | A | | 11/1971 | Davo |
| 3,662,318 | A | | 5/1972 | Decuyper |
| 3,689,865 | A | | 9/1972 | Pierini et al. |
| 3,697,926 | A | | 10/1972 | Krafthefer |
| 4,087,151 | A | | 5/1978 | Robert et al. |
| 4,125,308 | A | | 11/1978 | Schilling |
| 4,280,112 | A | | 7/1981 | Eisenhart |
| 4,346,355 | A | | 8/1982 | Tsukii |
| 4,656,441 | A | | 4/1987 | Takahashi et al. |
| 4,695,112 | A | | 9/1987 | Maston et al. |
| 4,724,409 | A | | 2/1988 | Lehman |
| 4,801,269 | A | | 1/1989 | Howard et al. |
| 5,046,952 | A | * | 9/1991 | Cohen et al. ..... 439/63 |
| 5,049,093 | A | | 9/1991 | Walter |
| 5,344,340 | A | | 9/1994 | Bouleau |
| 5,404,117 | A | * | 4/1995 | Walz ..... 333/34 |
| 5,411,409 | A | | 5/1995 | Gray et al. |
| 5,478,258 | A | * | 12/1995 | Wang ..... 439/581 |
| 5,657,385 | A | | 8/1997 | Reichle |
| 5,759,069 | A | | 6/1998 | Kitatani et al. |
| 5,879,177 | A | | 3/1999 | Honma |
| 5,897,384 | A | | 4/1999 | Hosler, Sr. |
| 6,007,347 | A | | 12/1999 | Keldsen et al. |
| 6,030,231 | A | | 2/2000 | Sarkiniemi |
| 6,065,976 | A | | 5/2000 | Wang |

(Continued)

*Primary Examiner*—James R. Harvey
(74) *Attorney, Agent, or Firm*—Merchant & Gould P.C.

(57) ABSTRACT

An adapter having a housing, a ground clip and an adapter subassembly all located in the housing. The adapter subassembly includes a proximal portion that can be coupled to a coaxial connector and a distal portion that can be coupled to a printed circuit board. A central conductor in the form of an elongated shaft that runs through the subassembly and has a ball contact end for contacting a conductor located on a printed circuit board and the elongated shaft is tapered in a region near the ball contact.

19 Claims, 7 Drawing Sheets

U.S. PATENT DOCUMENTS

| | | | | |
|---|---|---|---|---|
| 6,079,986 | A | 6/2000 | Beshears | |
| 6,100,774 | A | 8/2000 | Cox et al. | |
| 6,238,218 | B1 | 5/2001 | Baffert | |
| 6,468,089 | B1 | 10/2002 | Hubbard et al. | |
| 6,551,115 | B1 | 4/2003 | Li et al. | |
| 6,705,875 | B2 | 3/2004 | Berghorn et al. | |
| 6,776,656 | B2 | 8/2004 | Lehtonen et al. | |
| 6,935,866 | B2 * | 8/2005 | Kerekes et al. | 439/63 |
| 7,118,382 | B2 * | 10/2006 | Kerekes et al. | 439/63 |
| 2003/0186565 | A1 * | 10/2003 | Kerekes et al. | 439/63 |
| 2005/0215083 | A1 * | 9/2005 | Kerekes et al. | 439/63 |
| 2006/0258180 | A1 * | 11/2006 | Kerekes et al. | 439/63 |

* cited by examiner

CARD EDGE COAXIAL CONNECTOR

CROSS REFERENCE TO RELATED APPLICATIONS

This application is a continuation of U.S. patent application Ser. No. 11/138,093, filed May 26, 2005, now U.S. Pat. No. 7,118,382 which is a continuation of U.S. patent application Ser. No. 10/114,897, filed Apr. 2, 2002 and issued as U.S. Pat. No. 6,935,866 on Aug. 30, 2005, hereby incorporated by reference.

BACKGROUND OF THE INVENTION

Various types of electrical card edge connectors exist, however, very few are optimized for RF performance. Known RF card edge connectors require solder connections or complicated mechanical connections between a coaxial transmission line and a trace on a printed circuit board or complicated grounding techniques. These types of connectors make it difficult to replace the connectors quickly and easily. In addition, some connectors do not have a universal coaxial connection that allows the connector to be used with a variety of different types of coaxial connectors. Also, some of these known connectors are not modular so they do not easily lend themselves to being used in an array.

It is desirable to provide an adapter that does not require permanent couplings such as solder or tools to assemble the adapter to a printed circuit board so that the adapter can be easily and quickly replaced. In addition, it is desirable to provide an adapter that is modular so that it can be used singularly or in an array. Also, it is desirable to provide an adapter design that is independent of the coaxial connector interface so that various styles of coaxial connectors may be used with the adapter. In addition, it is desirable to provide an adapter that is simple to manufacture and inexpensive.

SUMMARY OF THE INVENTION

According to a first aspect of the invention, there is provided a high frequency adapter for coupling a printed circuit board having a signal trace and ground, to a coaxial connector. The adapter includes a housing, a ground clip and an adapter subassembly. The housing is designed to be removably coupled to the printed circuit board. The ground clip is located in a rear inner portion of the housing. The adapter subassembly includes a contact having a proximal portion and a distal portion and an elongated shaft coupling the proximal portion to the distal portion wherein the distal portion is configured to mate with the coaxial connector and the proximal portion is configured to mate with the printed circuit board. The elongated shaft is tapered in the proximal portion and the proximal portion terminates in a ball contact. The ball contact slides over the trace on the printed circuit board and electrically couples the trace on the printed circuit board to the contact. An insulator surrounds the contact and a conductive cylindrical connector surrounds the insulator so that the contact is concentrically positioned within the conductive cylindrical connector.

According to a second aspect of the invention, there is provided an adapter for coupling a printed circuit board to a coaxial connector. The adapter includes a housing and a center conductor. The housing has a first end and a second end, the first end of the housing is configured to be coupled to a standard coaxial connector, the second end of the housing has a printed circuit board receiving groove. The receiving groove is configured to slide over a portion of the printed circuit board. The center conductor is located within the housing and has a printed circuit board contacting end that slides over a conductive contact located on a first surface of the printed circuit board. The center conductor has a coaxial connector end opposite the printed circuit board contacting end and coupled thereto by an elongated shaft. The elongated shaft is tapered in a region remote from the coaxial connector and the coaxial contacting end is ball shaped.

DETAILED DESCRIPTION OF THE PREFERRED EMBODIMENT

Figure 1:
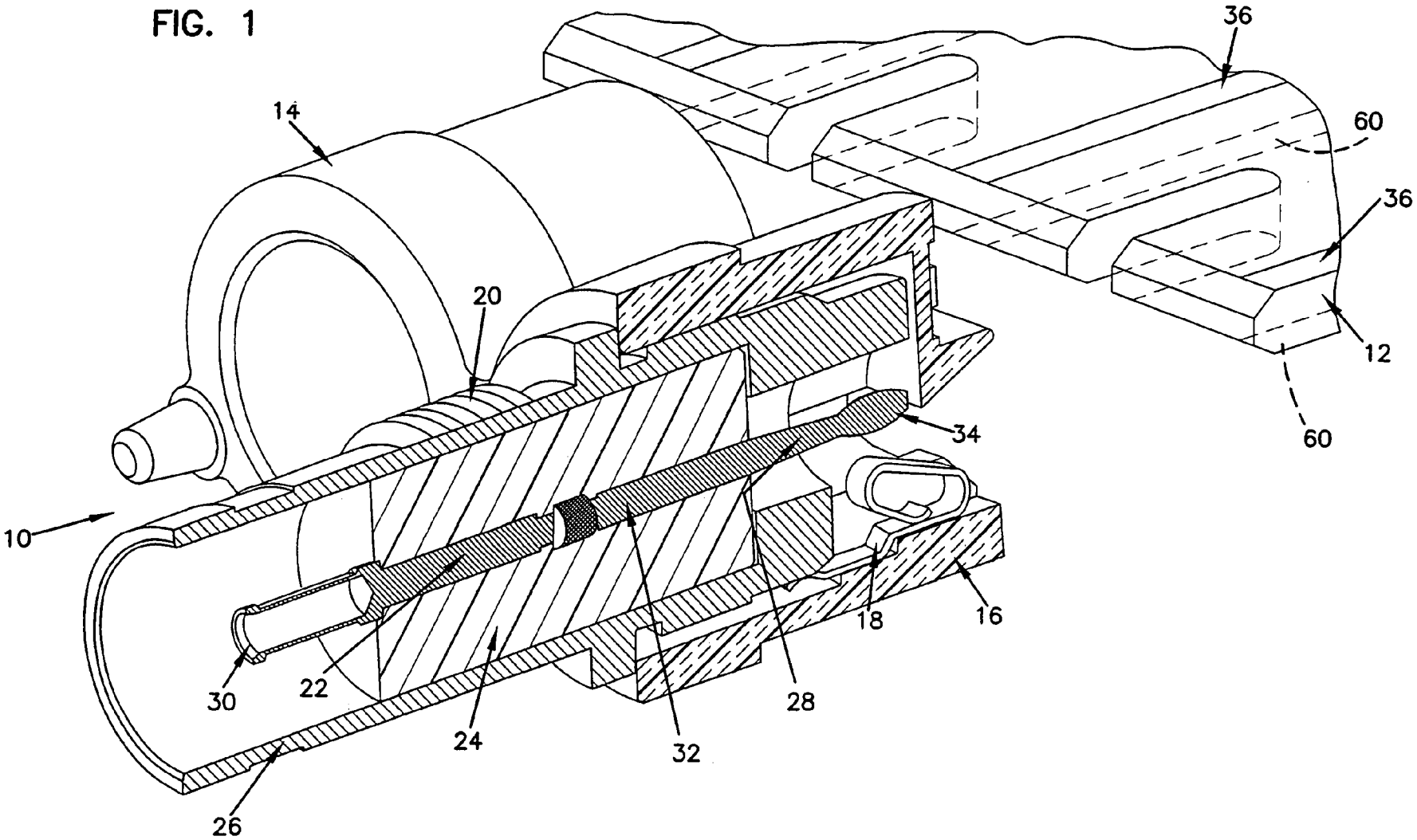
FIG. 1 is a cross-sectional perspective view of a high frequency adapter according to a preferred embodiment of the present invention.

FIG. 1 is a cross-sectional perspective view of a high frequency adapter 10 according to a preferred embodiment of the present invention. The adapter 10 is used to couple a printed circuit board 12 and a coaxial connector (not shown). The adapter 10 includes a housing 14 that is designed to be removably coupled to the printed circuit board 12. In addition, located in a rear inner portion 16 of the housing 14 is a ground clip 18. Also included in the housing 14 is an adapter subassembly 20 that includes a contact 22, an insulator 24 surrounding the contact 22 and a conductive cylindrical connector 26 surrounding the insulator 24. The contact 22 has a proximal portion 28 and a distal portion 30 and an elongated shaft 32 coupling the proximal portion 28 to the distal portion 30. The distal portion 30 of the contact 22 is designed to mate with a coaxial connector (not shown) and the proximal portion 28 of the contact 22 is designed to mate with the printed circuit board 12. The elongated shaft 32 is tapered in the proximal portion 28 and the proximal portion of the contact 22 terminates in a ball contact 34. When the adapter 10 is coupled to a printed circuit board 12, the ball contact 34 slides over a trace 36 located on the board 12 to electrically couple the trace 36 to the contact 22. The distal end 30 of the contact 22 can be electrically coupled to a coaxial connector (not shown). The adapter 10 thereby couples the printed circuit board 12 to a coaxial connector.

The adapter 10 can be coupled to any type of coaxial connector such as a BNC connector or an F connector, for example.

The tapered shape of the contact 22 allows the adapter 10 to reduce the impact of vibrations on the electrical connection between the contact 22 and the printed circuit board 12. In addition, it is flexible while still maintaining an acceptable level of stability. The ball contact 34 provides tolerance flexibility that allows the adapter to be coupled to a printed circuit board 12 that is not completely parallel with the axis of the contact 22.

In a preferred embodiment, the housing 14 is made of plastic. The contact 22 is press-fitted into the insulator 24 and the insulator 24 is press-fitted in the outer cylindrical conductive connector 26. The ground clip 18 is also press-fitted into the inner rear portion 16 of the housing 14.

Figure 6:
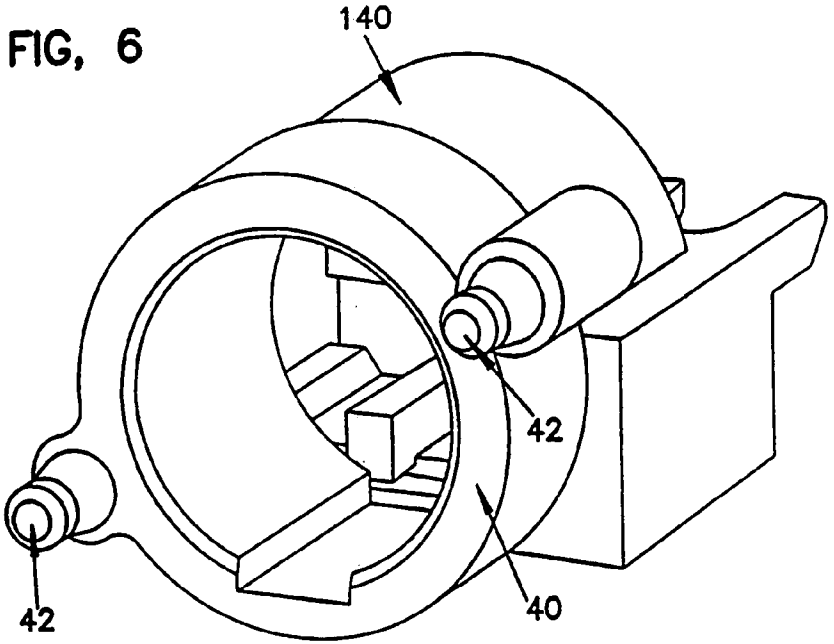
FIG. 6 is a perspective view of a single barrel housing according to a preferred embodiment of the present invention.
Figure 7:
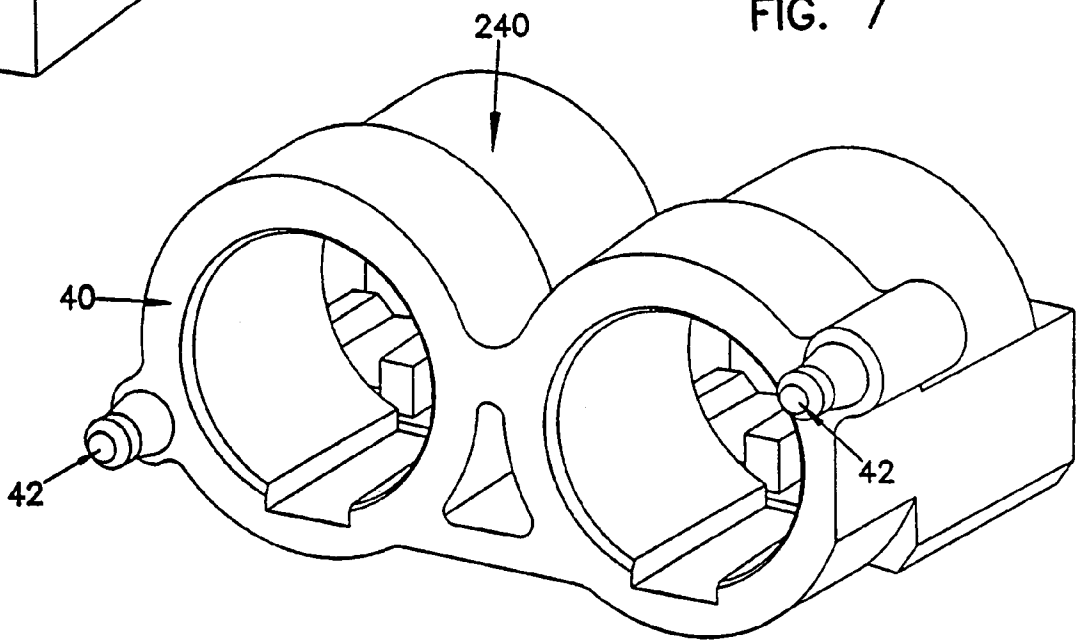
FIG. 7 is a perspective view of a double barrel housing according to a preferred embodiment of the present invention.
Figure 8:
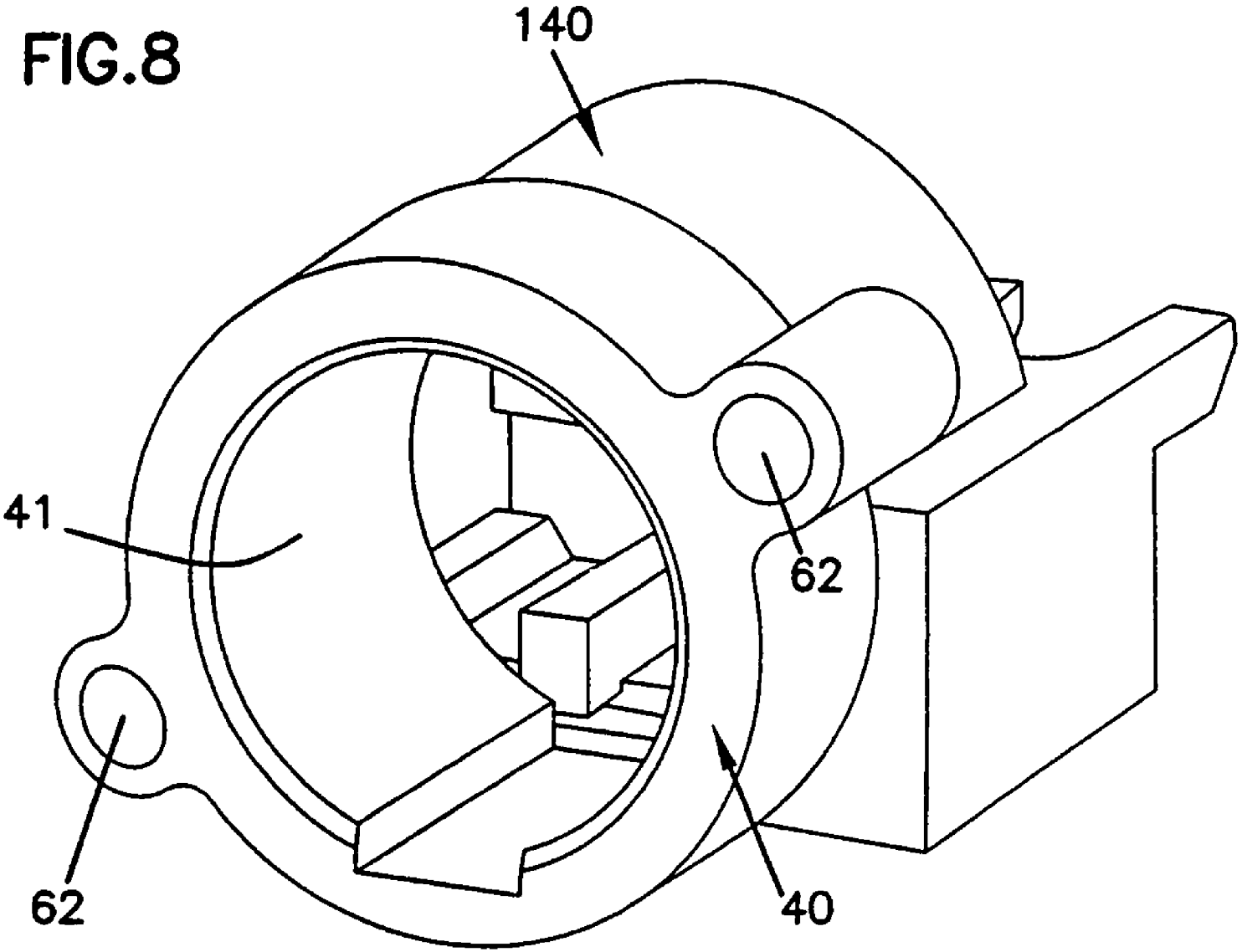
FIG. 8 is a perspective view of a single barrel housing according to an alternative embodiment of the present invention.

FIG. 6 is a perspective view of a single barrel housing 140 according to a preferred embodiment of the present invention which houses a single adapter subassembly 20. FIG. 7 is a perspective view of a double barrel housing 240 according to a preferred embodiment of the present invention which houses a pair of adapter subassemblies 20. Each housing 140, 240 has a front face 40 that has a pair of alignment pins 42 which fit into a panel (not shown) to properly align the housing 140, 240 with the panel. In the single barrel embodiment shown in FIG. 6, the pair of pins 42 are located on opposite sides of the barrel. In the double barrel embodiment shown in FIG. 7, one pin 42 is located on each barrel. Alternatively, the housing 140, 240 may be provided with holes 62 shown in FIG. 8 in place of the alignment pins 42 and the panel, on which the housing is mounted, may have alignment pins that fit into the holes in the housing for alignment purposes.

Figure 2:
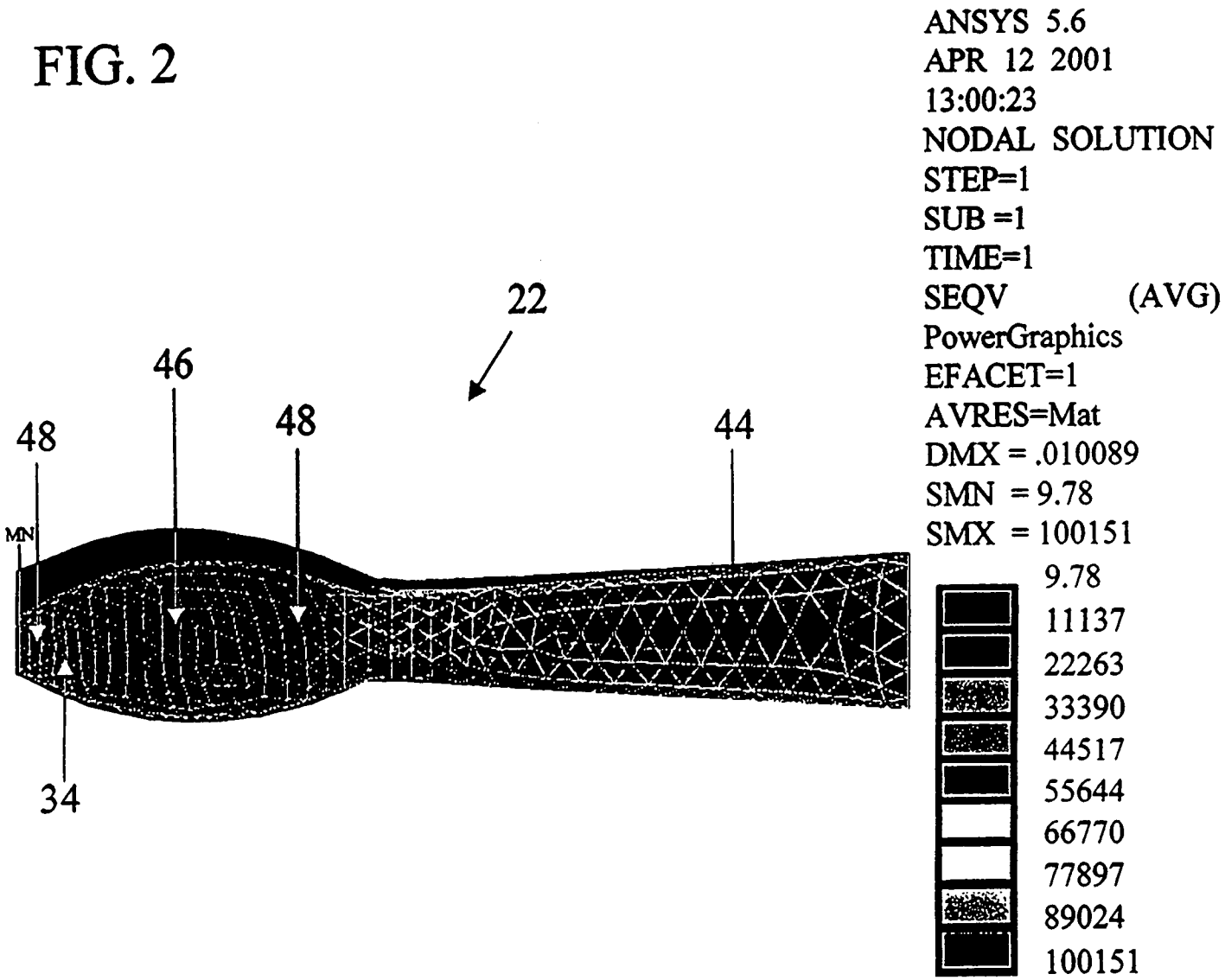
FIG. 2 is a side view of a proximal portion of a central contact.

FIG. 2 is a side view of a proximal portion of the central contact 22 shown in FIG. 1. As previously described, the proximal portion 28 of the contact 22 has a tapered section 44 and terminates in a ball contact 34. In a preferred embodiment, the ball contact 34 is elliptical in shape although it may have other shapes such as cylindrical, or oval, for example. The ball contact 34 has a central portion 46 and end portions 48 adjacent to the central portion 46. The end portions 48 include a first portion that connects the ball contact 34 to the tapered portion 44 and a second portion opposite the first portion that defines the proximal termination of the contact 22. The ball contact 34 is thickest at its central portion 46.

Figure 3:
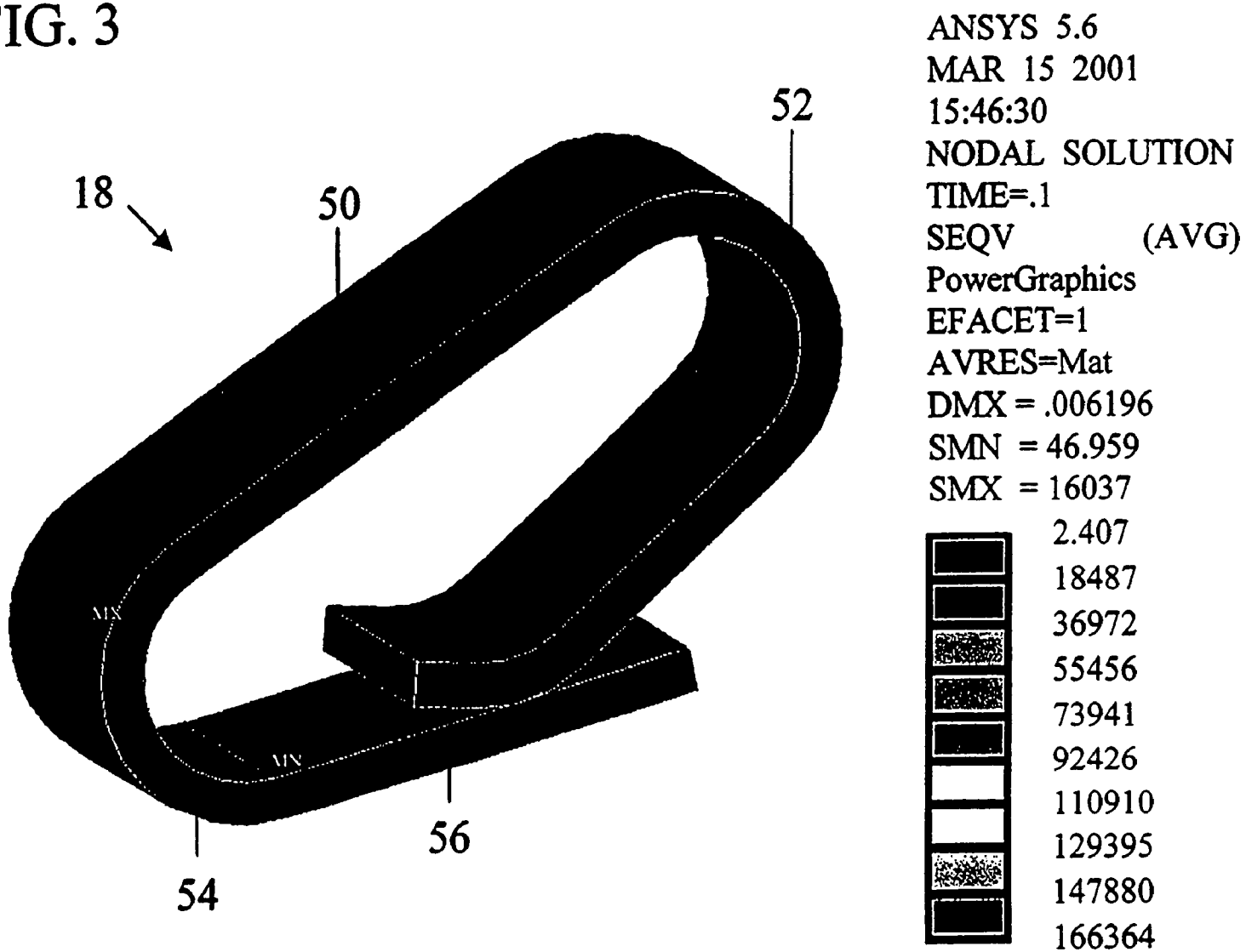
FIG. 3 is a perspective view of a ground clip according to a preferred embodiment the present invention.

FIG. 3 is a perspective view of a ground clip 18 according to a preferred embodiment the present invention. The ground clip is a spring having an elongated flat section 50, a first folded-over section 52 coupled at one end of the elongated flat section 50 and a second folded-over section 54 coupled at an opposite end of the elongated flat section 50. The first folded-over section 52 has a free end 56 that rides over a portion of the second folded-over section 54 to provide a spring force to the ground clip 18 so that when the adapter 10 is coupled to the printed circuit board 12, the ground clip 18 is compressed so that the elongated flat section 50 mates with a ground 60 shown in FIG. 1 located on an underside of the printed circuit board 12.

Figure 4:
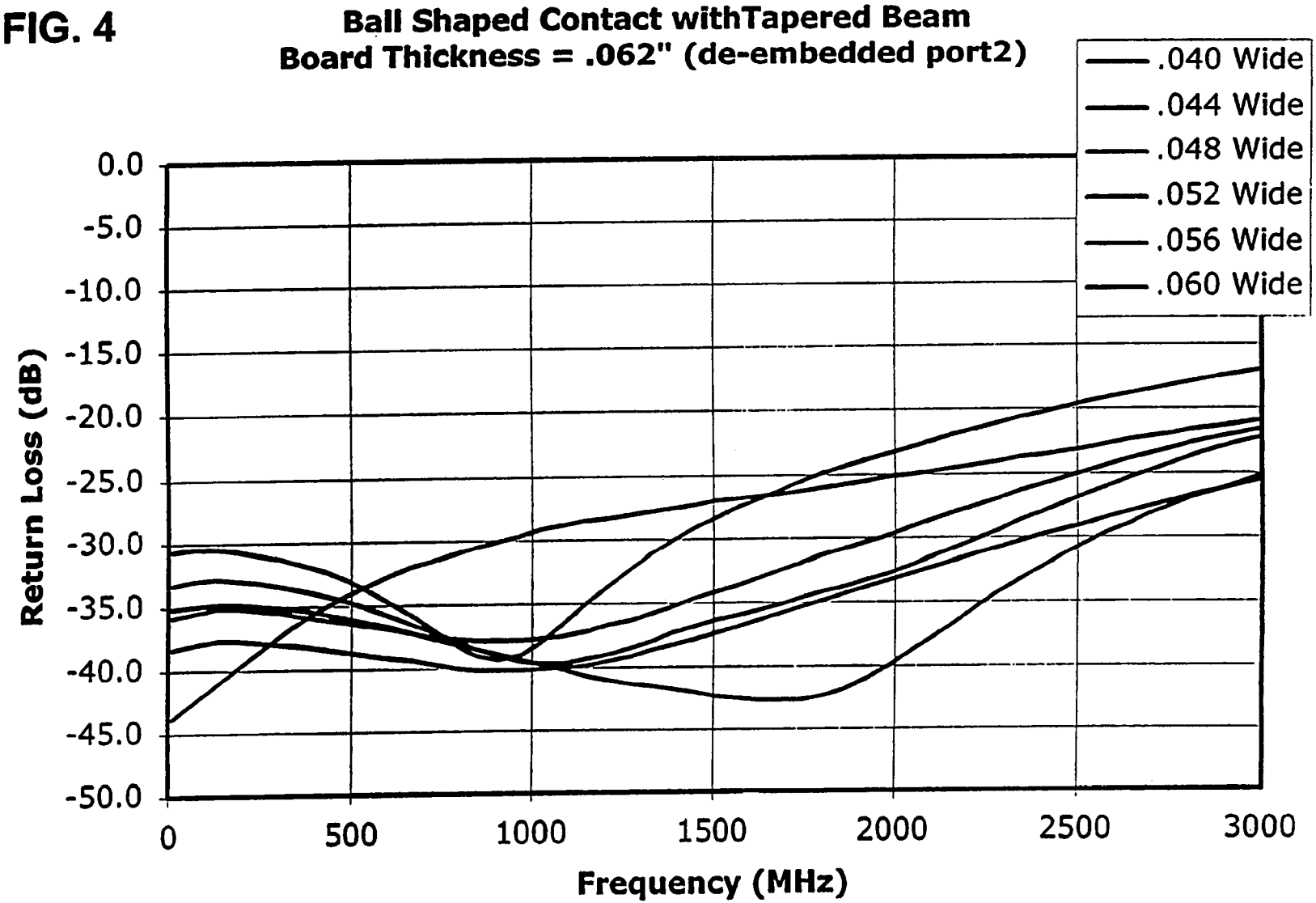
FIG. 4 is a graph illustrating simulated return loss for an adapter used with a printed circuit board having a first thickness according to a preferred embodiment of the present invention.

FIG. 4 is a graph illustrating simulated return loss for an adapter used with a printed circuit board having a first thickness according to a preferred embodiment of the present invention for various trace widths. A simulation was run for a contact as shown in FIG. 2 and a printed board thickness of about 0.062 inches. Return loss in decibels was plotted on the vertical axis and frequency in Megahertz was plotted along the horizontal axis. It can be seen from the graph that the simulated return loss is better than −30 decibels from dc to 2500 MHz.

Figure 5:
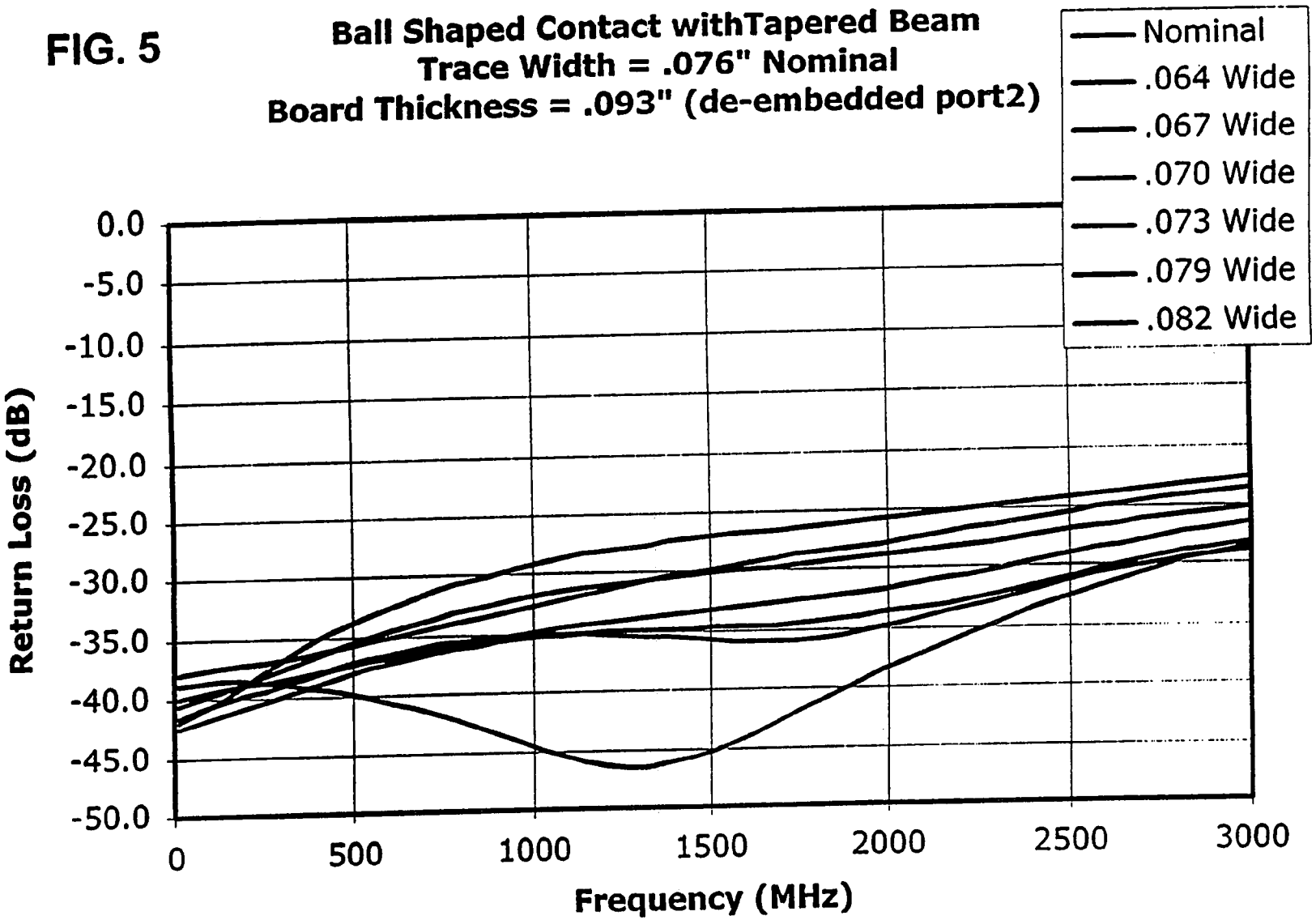
FIG. 5 is another graph illustrating simulated return loss for an adapter used with a printed circuit board of a second thickness according to a preferred embodiment of the present invention.

FIG. 5 is another graph illustrating simulated return loss for an adapter used with a printed circuit board of a second thickness according to a preferred embodiment of the present invention for various trace widths. A simulation was run for a contact as shown in FIG. 2 and a printed board thickness of about 0.093 inches. Return loss in decibels was plotted on the vertical axis and frequency in Megahertz was plotted along the horizontal axis. It can be seen form the graph that the simulated return loss is better than −30 decibels from dc to 2500 MHz.

The adapter has the advantage that it does not require permanent couplings such as solder or tools to assemble the adapter to a printed circuit board so that the adapter can be easily and quickly replaced. In addition, the adapter is modular so that it can be used singularly or in an array. The adapter design is also independent of the coaxial connector interface so that various styles of coaxial connectors may be used with the adapter.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An adapter for connecting a coaxial cable to a printed circuit board, the adapter comprising:

a housing including a first end and a second end, wherein the second end includes a first portion and a second portion separated by a space and disposed on opposite sides of a central opening through the housing;

a coaxial connector disposed at the first end of the housing within the central opening, the coaxial connector including a ground member disposed concentrically about a first end of a signal contact;

a conductive member in contact with the second portion of the second end of the housing, the conductive member electrically connected to the ground member of the coaxial connector; and wherein a second end of the signal contact is positioned within the housing between the first portion of the second end of the housing and the conductive member.

2. The adapter according to claim 1, wherein the second end of the signal contact and conductive member are aligned one on top of the other with a space therebetween.

3. The adapter according to claim 2, wherein the space between the first portion and the second portion is greater than the space between the ground member and the signal contact.

4. The adapter according to claim 3, wherein the space between the ground member and the signal contact is less than the thickness of an edge of a printed circuit board when the printed circuit board is not connected with the adapter and wherein the space between the ground member and the signal contact is equal to the thickness of the edge of the printed circuit board when the printed circuit board is connected with the adapter.

5. The adapter according to claim 4, wherein the space between the ground member and the signal contact is less than 0.093 inches when it is not connected to the printed circuit board.

6. The adapter according to claim 4, wherein the space between the ground member and the signal contact is less than 0.062 inches when it is not connected to the printed circuit board.

7. The adapter according to claim 1, wherein a portion of the coaxial connector is positioned outside of the housing.

8. The adapter according to claim 7, wherein the first end of the signal contact extends beyond the first end of the housing and wherein the ground member extends beyond the first end of the of the signal contact.

9. The adapter according to claim 1, wherein distal ends of the second end of the housing extend beyond the second end of the signal contact.

10. The adapter according to claim 9, wherein the first portion of the second end of the housing includes a lip that extends towards the second portion of the housing.

11. The adapter according to claim 10, wherein the lip portion is constructed of a non-conductive material.

12. The adapter according to claim 11, wherein the lip portion is constructed of a plastic material.

13. The adapter according to claim 1, wherein the conductive member contacts the ground member of the coaxial connector.

14. The adapter according to claim 1, wherein the conductive member is positioned within the housing.

15. The adapter according to claim 9, wherein the conductive member is positioned within the housing.

16. The adapter according to claim 1, wherein the coaxial connector is a bayonet style coaxial cable connector.

17. The adapter according to claim 1, wherein the coaxial connector is a 75 ohm coaxial cable connector.

18. The adapter according to claim 1, wherein the second end portion of the housing includes an opening, wherein the opening of the housing is constructed of a material that enables the opening to deform and frictionally receive the coaxial connector.

19. An adapter for connecting a coaxial cable to a printed circuit board, the adapter comprising:

a housing including a first end and a second end, wherein the second end includes a first portion and a second portion separated by a space and disposed on opposite sides of a central opening through the housing, wherein the housing is constructed of a non-conductive material;

a coaxial connector disposed at the first end of the housing within the central opening, the coaxial connector including a ground member disposed concentrically about a first end of a signal contact;

a conductive member in contact with the second portion of the second end of the housing, the conductive member electrically connected to the ground member of the coaxial connector; and wherein a second end of the signal contact is positioned within the housing between the first portion and the second portion of the second end of the housing.

* * * * *